United States Patent [19]

Fisher

[11] 3,963,097

[45] June 15, 1976

[54] FIRE LADDER

[75] Inventor: Richard Fisher, New York, N.Y.

[73] Assignee: Lawrence Peska Associates, Inc., New York, N.Y. ; a part interest

[22] Filed: Mar. 26, 1975

[21] Appl. No.: 562,198

[52] U.S. Cl. ..... 182/76
[51] Int. Cl.[2] ..... E06C 9/14
[58] Field of Search ..... 182/76, 70, 73, 77, 182/196

[56] References Cited

UNITED STATES PATENTS

| | | | |
|---|---|---|---|
| 1,135,738 | 4/1915 | Stinchcomb | 182/76 |
| 1,753,798 | 4/1930 | Martin | 182/70 |
| 1,914,889 | 6/1933 | Lugara | 182/70 |
| 2,388,678 | 11/1945 | Dahlander | 182/70 |
| 3,392,380 | 7/1968 | Fordyce | 182/18 |

*Primary Examiner*—Reinaldo P. Machado
*Attorney, Agent, or Firm*—Jack D. Slobod

[57] ABSTRACT

A flexible fire ladder is stowed in a housing mounted between a pair of projecting beams within a decorative overhang over a window of a building. The housing is either underside a pivotly mounted hopper, or is formed by a soffit below the roof overhang and includes a pivotly mounted door. In either event, the hopper or door is retained in place by a catch. A cable for articulating the catch passes within the building wall to a handle mounted near the window. The cable may be pulled either manually by the handle or by a solenoid responsive to a fire detector.

4 Claims, 3 Drawing Figures

FIG. 1
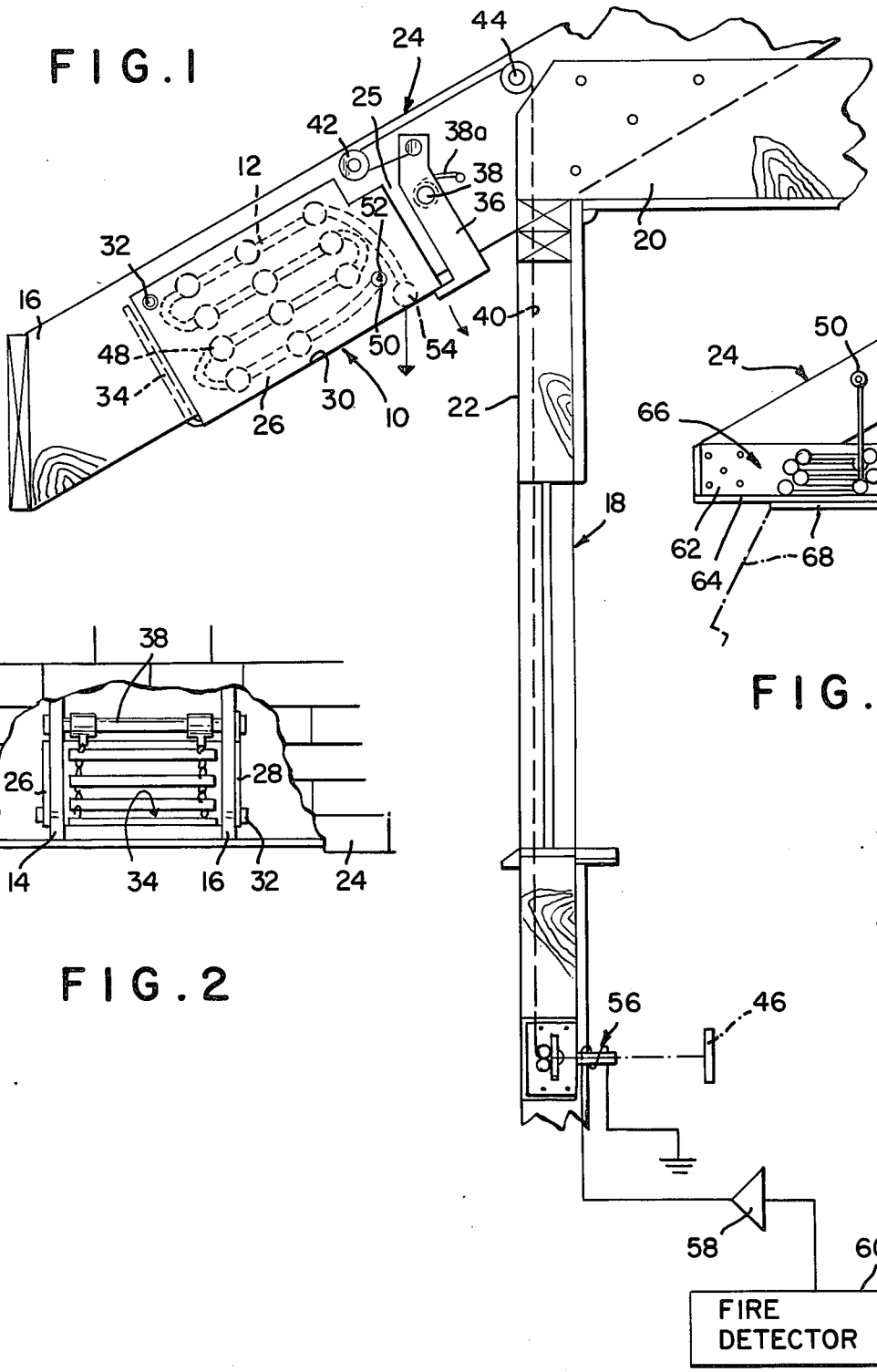
FIG. 3
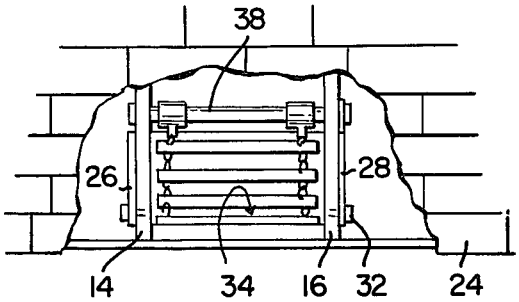
FIG. 2

FIRE LADDER

FIELD OF THE INVENTION

The present invention relates generally to collapsible ladders stowed for use in emergency escape from the windows of a building. In its particular aspects, the present invention relates to the provision of a stowed collapsible ladder within a decorative overhang over the window of a building.

BACKGROUND OF THE PRESENT INVENTION

Today, permanent rigid fire escapes are provided for emergency escape from the windows of a multiple story dwelling. While it is generally known that stowed flexible fire ladders, such as illustrated in U.S. Pat. No. 1,123,029 to Smith, could be provided in proximity to the windows of a building at less cost than rigid fire escapes, such stowed flexible fire escape ladders have not enjoyed any substantial use since the issuance of the aforementioned Smith patent in 1914. It is believed that the reason for this lack of use is that the exposed ladder housing on the outside of the building is obtrusive to the eye.

Furthermore, in the prior art, it has not been possible to have such stowed ladders automatically deployed, in the event of fire, where they could be used by firefighters as a means of access to a burning building.

OBJECTS OF THE PRESENT INVENTION

It is an object of the present invention to provide stowed deployable escape ladder on the outside of a building in a manner which is unobtrusive to the eye.

It is a further object of the present invention to provide a system for deploying a stowed fire ladder which is automatic.

SUMMARY OF THE PRESENT INVENTION

Briefly, the aforementioned and other objects are satisfied by providing a housing containing a stowed fire ladder within a decorative overhang over a window of a building. The overhang, which includes beams projecting from a wall of the building, may be an overhanging extension of the building roof or may be a canopy constructed over a window and attached to a ceiling joist. By providing the housing for a stowed fire ladder within an overhang the housing is thereby hidden from view.

The housing includes a pivotly mounted underside which is retained in a closed position by a catch. For unlocking the catch a cable attached thereto is passed within and then through the wall to the interior of the building terminating at a handle. In order for the fire ladder to be automatically deployed in the event of fire, the cable is pulled by an actuation which forms a part of a fire detector.

Other objects and features of the present invention will become apparent upon a perusal of the following detailed description of two embodiments thereof when taken in conjunction with the drawing wherein:

FIG. 1 is a side elevational view of a stowed fire ladder above a window.

FIG. 2 is a partially broken away front elevational view corresponding to FIG. 1.

FIG. 3 is a side elevational view similar to FIG. 1 but of an alternate embodiment.

DETAILED DESCRIPTION

Referring first to FIGS. 1 and 2, according to one embodiment of the present invention, a housing 10 in the form of a hopper contains a folded flexible fire ladder 12 as of rope, and is mounted between beams 14 and 16 above window 18. Beams 14 and 16, which are nailed to ceiling joist 20 above window 18 and project horizontally and downwardly from building wall 22, are preferably rafters of the overhanging roof 24 of a building. By providing housing 10, within roof overhang 24, the housing is hidden from view in an unobtrusive manner.

Housing 10, which may be inexpensively fabricated from vinyl plastic, for weather resistance, is preferably a rectangular hopper open at the top and having a mouth 25. Housing 10 is mounted on the same slope as beams 14 and 16 and includes sidewalls 26 and 28 upstanding from a bottom wall 30 and respectively held against and parallel to the outer side surfaces of beams or rafters 14 and 16. Housing 10 is pivotly mounted for downward rotation between the rafters about a pin 32 which passes transversely through the beams 14 and 16 and the sidewalls 26 and 28. Passing transversely between beams 14 and 16 is an upstanding bottom sidewall 34 of housing 10 which serves to stop the folded flexible ladder 12 from sliding down the inclined bottom wall or underside 30 of housing 10.

Housing 10 is retained in a position wherein its underside 30 is at the same slope as the beams 14 and 16 by a catch 36 mounted on a pivot rod 38 passing transversely between rafters 14 and 16. Catch 36 is urged against the bottom of housing underside 30 by a torsional spring 38 and may be rocked counterclockwise about pivot 38 by pulling a cable 40 attached to catch 36 and appropriately threaded over pulley rollers 42 and 44.

Cable 40, passes through and downward along the hollow interior of building wall 22 and terminates with a handle or gripping member 46 mounted proximate to window 18 on the inside of the building whereby handle 46 may be pulled to deploy the stowed ladder 12.

Ladder 12, which preferably comprises a rope ladder with lightweight wood or aluminum rungs 48, is folded forward and backward in layers. The bottom layer terminates in a tubular rung 50 through which passes a transverse pin 52 between rafters 14 and 16. The top layer, which is a free end, terminates in a rung 54 which rests on underside 30 close to housing mouth 25 whereby to deploy ladder 12 the free end of the ladder falls when hopper 10 rotates mouth 20 downward.

For automatically deploying ladder 12 in response to a fire, a solenoid or actuator 56 is provided near handle 46 for pulling cable 40. Solenoid 56 is driven by a buffer amplifier 58 responsive to an electronic fire detector 60 of the type sensitive to heat and smoke. It should be understood that various stowed fire ladders 12 could be deployed automatically in response to one fire detector or fire detector system 60.

For the type of roof where a horizontal board or soffit is provided to close off the bottom of the roof overhang 24 the embodiment of FIG. 3 is utilized. This embodiment is also particularly appropriate for building a decorative shingle-covered canopy over the window 18 to hold the ladder 12.

Referring to FIG. 3, horizontal beams 62 project from building wall 22 and are nailed to the free end of downwardly inclined beams or rafters 14. Horizontal ply-boards 64 are nailed to the bottom of horizontal beam 62 to close off the roof overhang 24.

In effect, a housing 66 for folded ladder 12 is formed between a pair of horizontal beams 62 and above the soffit board 64. A rectangular cutout is formed in board 64 and a hinged door 68, as of vinyl, is fitted therein and retained by catch 36 in the same manner as how the housing underside 30 in FIG. 1 is retained. Thus as in FIG. 1, to deploy ladder 12, cable 40 is pulled, catch 36 is rocked about its pivot releasing the door 66 to make a clockwise downward motion.

Having described two embodiments of the present invention it should be apparent that numerous modifications are possible within its spirit and scope.

What is claimed is:

1. In combination with a multiple story buildng having an overhanging roof including a plurality of spaced apart downwardly inclined projecting rafters, a stowed flexible escape ladder apparatus comprising: a hopper mounted extending across a pair of said rafters and pivoted to the rafters for selective downward rotation at a location above a window of said building; said hopper being a unitary body having a bottom generally rectangular wall normally inclined extending along and between bottom edges of said rafters, generally planar sidewalls upstanding from opposite sides of said bottom wall, in sliding engagement with sides of said rafters, a rear wall upstanding between said rafters from a rear, normally lower, edge of said bottom wall, a front, normally higher, edge of said bottom wall defining a mouth of said hopper which is adapted to lie below said rear wall in response to downward rotation of said hopper; a folded flexible ladder within said hopper having one end secured to said rafters; catch means biased against the underside of the bottom wall of said hooper for releasably holding said hopper in said normal inclination; a cable having one end connected to said catch means in a manner for articulating said catch means in response to pulling of said cable; and means within said building connected to said cable for pulling said cable for releasing said hopper to rotate downwardly and thereby deploying said ladder.

2. The apparatus of claim 1 where interior surfaces of said sidewalls are in sliding engagement with said rafters.

3. The apparatus of claim 1 wherein said pulling means comprises a grip member mounted proximate to said window.

4. The apparatus of claim 1 wherein said pulling means comprises a solenoid.

* * * * *